US006769926B1

(12) United States Patent
Montena

(10) Patent No.: US 6,769,926 B1
(45) Date of Patent: Aug. 3, 2004

(54) ASSEMBLY FOR CONNECTING A CABLE TO AN EXTERNALLY THREADED CONNECTING PORT

(75) Inventor: Noah P. Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 10/614,486

(22) Filed: Jul. 7, 2003

(51) Int. Cl.[7] ..... H01R 4/38
(52) U.S. Cl. ..... 439/253; 439/578
(58) Field of Search ..... 439/253, 254, 439/255, 256, 257, 578

(56) References Cited

U.S. PATENT DOCUMENTS

| | | | | |
|---|---|---|---|---|
| 1,818,380 A | * | 8/1931 | Cartier | 40/550 |
| 2,682,039 A | * | 6/1954 | Tinnerman | 439/253 |
| 3,430,184 A | | 2/1969 | Acord | |
| 3,452,316 A | | 6/1969 | Panek et al | |
| 3,484,736 A | | 12/1969 | Wyse | |
| 3,723,944 A | | 3/1973 | Gauchat et al | |
| 4,941,846 A | | 7/1990 | Guimond et al. | |
| 5,024,604 A | | 6/1991 | Savin et al. | |
| 5,059,139 A | | 10/1991 | Spinner | |
| 5,195,906 A | | 3/1993 | Szegda | |
| 6,267,612 B1 | | 7/2001 | Arcykiewicz et al. | |

* cited by examiner

*Primary Examiner*—Tho D. Ta
*Assistant Examiner*—James R. Harvey
(74) *Attorney, Agent, or Firm*—Wood, Phillips, Katz, Clark & Mortimer

(57) ABSTRACT

An assembly for connecting a cable to an externally threaded connecting port. The connecting assembly has a tubular fitting with a central axis and axially spaced first and second ends. The first end is adapted to receive the cable. The second end is adapted to engage an externally threaded connecting port to secure the connecting assembly to the externally threaded connecting port. The connecting assembly has a plurality of fingers projecting generally in a first axial direction. A first finger in the plurality of fingers has an axial length between axially spaced connected and free ends and a prong that projects generally oppositely to the first axial direction from a first axial location on the first finger. A locking member is movable axially relative to the first finger between first and second positions. The locking member has a surface that cooperates with a surface on the first finger to produce a bias force on the first finger radially inwardly relative to the central axis as the locking member is moved from the first position into the second position. The bias force is produced on the first finger between the first location and the connected end of the first finger.

37 Claims, 4 Drawing Sheets

ASSEMBLY FOR CONNECTING A CABLE TO AN EXTERNALLY THREADED CONNECTING PORT

BACKGROUND OF THE INVENTION

1. Field of the Invention

This invention relates to connectors and, more particularly, to a connecting assembly that can be used in place of a conventional nut to connect a cable to an externally threaded connecting port.

2. Background Art

A myriad of connecting assemblies are currently available for connecting a cable, such as a coaxial cable, to an externally threaded connecting port. The nature of the structure having the externally threaded connecting port may vary considerably. For example, the connecting port may be at a drop or splice location.

One of the most commonly utilized connecting structures in the cable industry is a nut that is aligned with, and rotated relative to, an externally threaded connecting port to selectively secure the cable thereto and release the cable therefrom.

In certain environments, the requirement to repeatedly turn a nut is awkward and undesirably time consuming. As an alternative to a threaded connection, many different connecting assemblies are offered which permit operation by translation of the connecting assembly parallel to the axis of the externally threaded connecting port. In one form, a cylindrical sleeve is formed with circumferentially spaced, axially extending, slits which produce a plurality of independently movable fingers. Such a structure is shown in U.S. Pat. No. 5,195,906, to Szegda. The tenacity of the grip of such a connecting assembly upon the externally threaded connecting port is determined by the captive compressive force between diametrically opposite fingers. This type of connecting assembly has the drawback that it may be inadvertently separated from the externally threaded connecting port. The individual fingers are also prone to being deformed, which may affect the holding capacity.

Many different connecting assemblies utilize the aforementioned deformable finger arrangement and additionally employ a locking ring which surrounds, and is axially movable relative to, the fingers to bias the fingers radially inwardly so as to more positively grip the externally threaded connecting port. A number of these connecting assemblies have fingers which include a projection which is pressed by the locking ring to radially between adjacent thread turns so as place surfaces on the finger projections and threads in axially confronting relationship. So long as this confronting relationship is maintained, the connecting assembly cannot be axially separated from the externally threaded connecting port.

Many of these connecting assemblies function such as a collet. That is, a force from the locking ring is rigidly transmitted through the fingers to the externally threaded connecting port. While the connection through this connecting assembly may be positively maintained, this type of connecting assembly is generally designed for a specific diameter of externally threaded connected port and may not function adequately if the diameter thereof is appreciably less than, or greater than, the specific diameter for which the connecting assembly is designed. Examples of this type of structure are shown in U.S. Pat. No. 3,452,316, to Panek et al, and U.S. Pat. No. 4,941,846, to Guimond et al.

Designers of cable connectors continue to seek out cable connecting assemblies that can be simply operated, produce a secure holding force between the connecting assembly and a cooperating externally threaded connecting port, and accommodate a range of diameters for an externally threaded connecting port with which the connecting assembly is to be used.

SUMMARY OF THE INVENTION

In one form, the invention is directed to an assembly for connecting a cable to an externally threaded connecting port. The connecting assembly has a tubular fitting with a central axis and axially spaced first and second ends. The first end is adapted to receive a cable. The second end is adapted to engage an externally threaded connecting port to secure the connecting assembly to the externally threaded connecting port. The connecting assembly has a plurality of fingers projecting generally in a first axial direction. A first finger in the plurality of fingers has an axial length between axially spaced connected and free ends and a prong that projects generally oppositely to the first axial direction from a first axial location on the first finger. A locking member is movable axially relative to the first finger between first and second positions. The locking member has a surface that cooperates with a surface on the first finger to produce a bias force on the first finger radially inwardly relative to the central axis as the locking member is moved from the first position into the second position. The bias force is produced on the first finger between the first location and the connected end of the first finger.

In one form, the prong is substantially straight and projects in a line that is nonparallel to the central axis.

The first finger may be folded at the free end to define the prong.

In one form, the first axial location is at the free end of the first finger.

In one form, there is a sleeve assembly at the first end of the tubular fitting for receiving a cable and the locking member abuts to the sleeve assembly with the locking member in the first position so as to prevent movement of the locking member from the second position to past the first position.

In one form, the locking member has a radially inwardly projecting bead that abuts to the sleeve assembly with the locking member in the first position.

The locking member may surround a portion of the sleeve assembly.

In one form, the locking member surface has an annular shape with a diameter that changes along an axial extent thereof.

The locking member may have a cylindrical shape that extends continuously around the plurality of fingers.

In one form, the locking member is made from a plastic material.

In one form, the prong projects in a line and terminates at a free edge which is substantially straight and extends transversely to the line at which the prong projects.

In one form, the free edge is pointed.

The fingers in the plurality of fingers may have substantially the same configuration as the first finger.

In one form, the prong projects in a line and is flexible relative to the first finger to change the orientation of the line relative to the first finger.

In one form, the prong resides radially inside of the first finger.

The invention is further directed to an assembly for connecting a cable to an externally threaded connecting port and having a tubular fitting with a central axis and axially spaced first and second ends. The first end is adapted to receive a cable. The second end is adapted to engage an externally threaded connecting port to secure the connecting assembly to the externally threaded connecting port. The connecting assembly has a plurality of fingers projecting generally in a first axial direction. The first finger in the plurality of fingers has an axial length between axially spaced connected and free ends and a prong projecting generally oppositely to the first axial direction from a first location on the first finger. The locking member is movable between first and second positions. The locking member produces a bias force on the first finger that moves at least a part of the first finger radially inwardly relative to the central axis as the locking member is moved from the first position into the second position. The prong projects in a line and is flexible relative to the first finger to change the orientation of the line relative to the first finger.

The first finger may be folded at the free end to define the prong.

The first axial location may be at the free end of the first finger.

In one form, the bias force is produced on the first finger between the first location and the connected end of the first finger. In one form, the locking member has an annular shape and is movable axially between the first and second positions.

The fingers in the plurality of fingers may have substantially the same configuration as the first finger.

In one form, the prong resides radially inside of the first finger. The invention is further directed to the combination of an externally threaded connecting port and an assembly for connecting a cable to the externally threaded connecting port. The externally threaded connecting port has threads with an external diameter and axially oppositely facing surfaces. The connecting assembly has a tubular fitting with a central axis and axially spaced first and second end. The first end is adapted to receive a cable. The second end engages the externally threaded connecting port. The connecting assembly has a plurality of fingers projecting generally in a first axial direction. A first finger in the plurality of fingers has an axial length between axially spaced connected and free ends and a prong projecting generally oppositely to the first axial direction from a first axial location on the first finger. The locking member has a surface that cooperates with a surface on the first finger to produce a bias force on the first finger radially inwardly relative to the central axis as the locking member is moved from the first position into the second position. The locking member can be selectively placed, and frictionally maintained, in each of the first and second positions.

In one form, the second end of the tubular fitting has a receptacle for the externally threaded connecting port and with the locking member in the first positions the first finger is biased radially outwardly so as not to engage the threads on the externally threaded connecting port as the externally threaded connecting port is directed axially relative to, and into, the receptacle in the second end of the tubular fitting.

The first finger may be folded to define the prong.

In one form, the first finger is folded at the free end of the first finger.

In one form, the fingers in the plurality of fingers have substantially the same configuration as the first finger.

In one form, the prong projects in a line and is flexible relative to the first finger to change the orientation of the line relative to the first finger.

In one form, with the locking member in the second position, the first finger is biased so that the prong resides in radially overlapping relationship with one of the axially oppositely facing thread surfaces.

The invention is further directed to the combination of an externally threaded connecting port and an assembly for connecting a cable to the externally threaded connecting port. The externally threaded connecting port has threads with an external diameter and axially oppositely facing surfaces. The connecting assembly has a tubular fitting with a central axis and axially spaced first and second ends. The first end is adapted to receive a cable. The second engages the externally threaded connecting port. The connecting assembly has a plurality of fingers projecting generally in a first axial direction. A first finger in the plurality of fingers has an axial length between axially spaced connected and free ends and a prong projecting generally oppositely to the first axial direction from a first axial location on the first finger. The first finger is normally biased to a release position. The connecting assembly further includes a locking member. The locking member and at least the plurality of fingers cooperate to (a) allow the locking member to be placed and frictionally maintained in the first and second positions, (b) bias the first finger into a locked position wherein the prong extends into radially overlapping relationship with one of the axially oppositely facing thread surfaces, with the locking member in the second position, and (c) allow the first finger to assume the release position wherein the prong resides outside of the external diameter of the threads with the locking member in the first position.

In one form, the second end of the tubular fitting has a receptacle for the externally threaded connecting port. With the locking member in the first position, the first finger is biased radially outwardly so as not to engage the threads on the externally threaded connecting port as the externally threaded connecting port is directed axially relative to, and into, the receptacle in the second end of the tubular fitting.

The first finger may be folded to define the prong.

In one form, the fingers and the plurality of fingers may have substantially the same configuration as the first finger.

The invention is further directed to a method of connecting a cable to an externally threaded connecting port having threads, with the threads having an external diameter and axially oppositely facing surfaces. The method includes the step of providing a connecting assembly having a) a tubular fitting with a central axis and axially spaced first and second ends, b) a plurality of fingers projecting generally in a first axial direction so that the plurality of fingers cooperatively define a receptacle, with a first finger in the plurality of fingers having an axial length between axially spaced connected and free ends and a prong projecting generally oppositely to the first axial direction from a first axial location on the first finger, and c) a locking member that is movable relative to the first finger between first and second positions. The method further includes the steps of: moving the locking member into the first position so that the locking member is frictionally maintained in the first position; with the locking member in the first position, directing the externally threaded connecting port into the receptacle so that the first finger is in a position wherein the prong on the first finger does not engage the threads on the externally threaded connecting port; with the externally threaded connecting port in the receptacle, moving the locking member from the first position towards the second position and thereby causing the locking member to produce a force on the first finger that biases the first finger so as to situate the prong in radially overlapping relationship with one of the axially oppositely facing thread surfaces so that the prong abuts to the one of the axially oppositely facing thread surfaces to prevent separation of the externally threaded connecting port and connecting assembly by relative axially opposite movement; and connecting a cable to the second end of the tubular fitting.

In one form, the step of moving the locking member involves causing the locking member to produce the force from a location between the connected and free ends of the first finger.

The step of providing a connecting assembly may involve providing a connecting assembly with a plurality of fingers that are substantially the same as the first finger and which cooperate with the locking member in substantially the same manner as the locking member cooperates with the first finger.

The step of moving the locking member may involve causing the locking member to produce a force that repositions the prong relative to the first finger.

DETAILED DESCRIPTION OF THE DRAWINGS

Figures 1, 2:
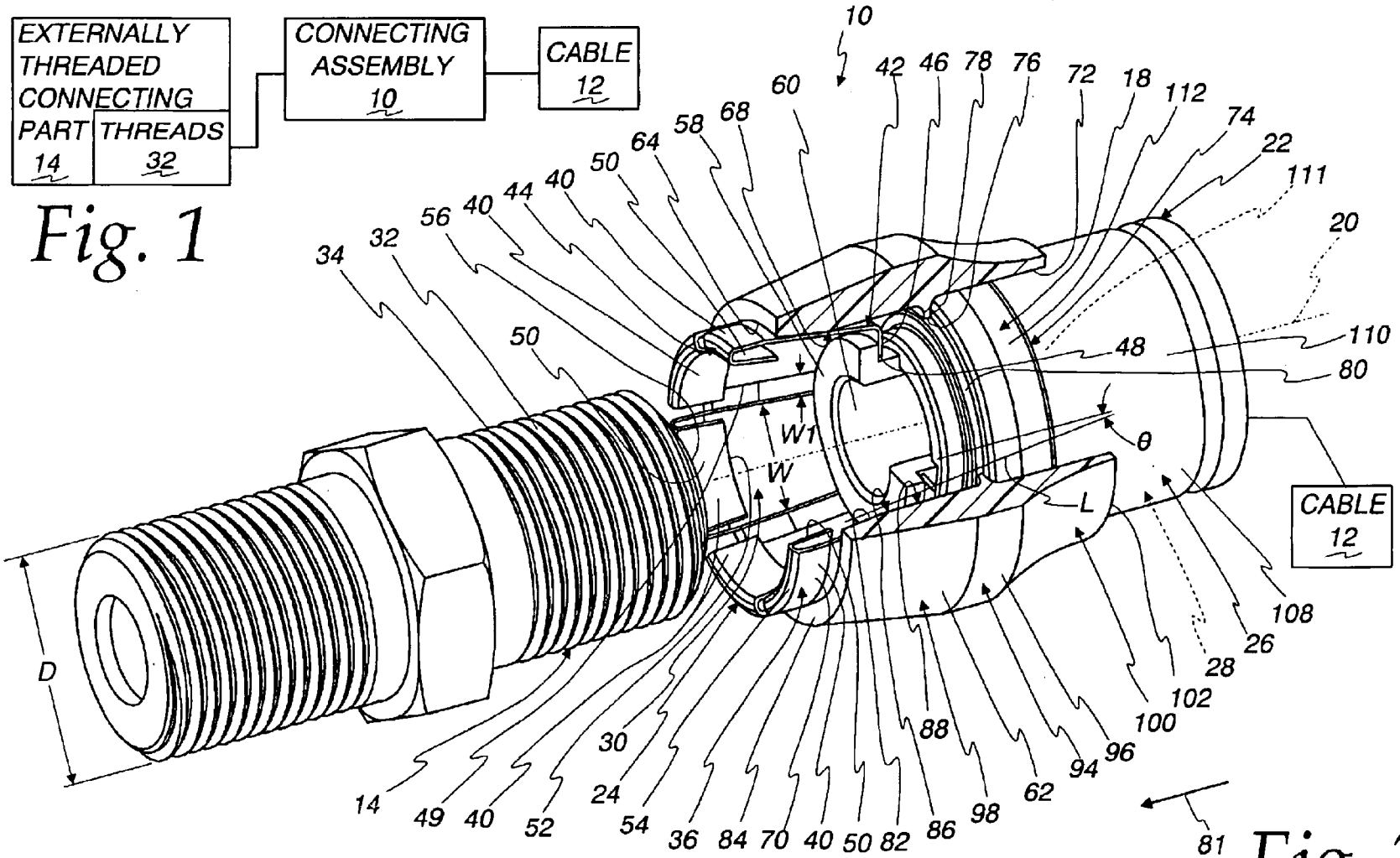
FIG. 1 is a schematic representation of a generic environment for the present invention, and consisting of a connecting assembly to join a cable to an externally threaded connecting port.
FIG. 2 is an exploded perspective view of one form of the inventive connecting assembly in relationship to an externally threaded connecting port and having a ferrule assembly with fingers that are deformable by movement of a locking member, and with the locking member in a first position and the fingers in a release state.

In FIG. 1, a schematic representation of a generic system environment for the present invention is shown. The system consists of an assembly at 10 for connecting a cable 12 to an externally threaded connecting port 14. The externally threaded connecting port 14 can be virtually any structure to which cable is conventionally electrically/mechanically connected. As one possible system configuration, the cable 12 is a coaxial cable that is connected through the connecting assembly 10 to the externally threaded connecting port 14. The externally threaded connecting port 14 may be a splice component, a drop connection port, a part of a component such as a filter, or virtually any other component to which an end of a coaxial cable is conventionally joined.

Figure 3:
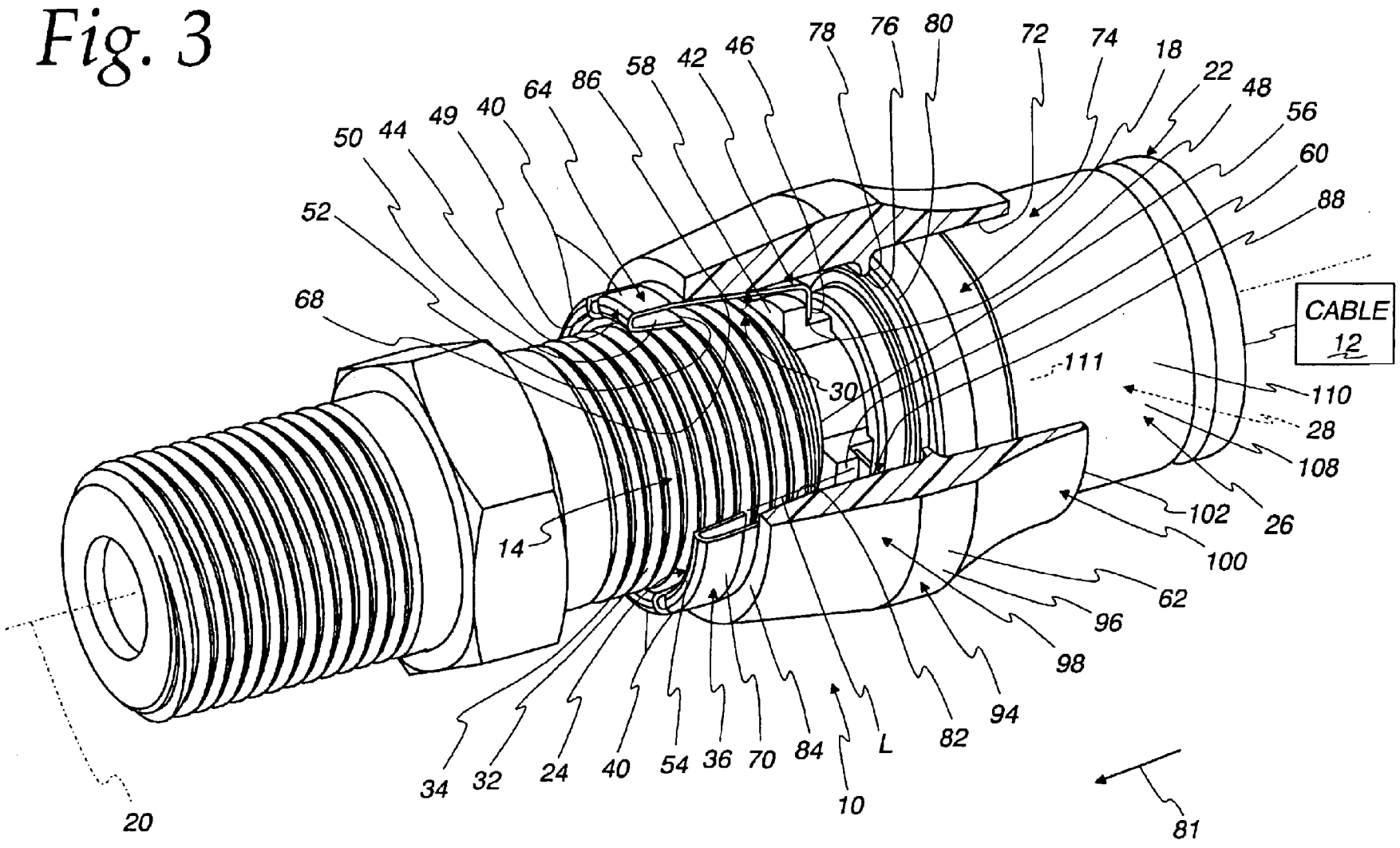
FIG. 3 is a view as in FIG. 2 with the externally threaded connecting port in a receptacle defined by the ferrule assembly and with the locking member in its first position and the fingers in the release state.
Figure 4:
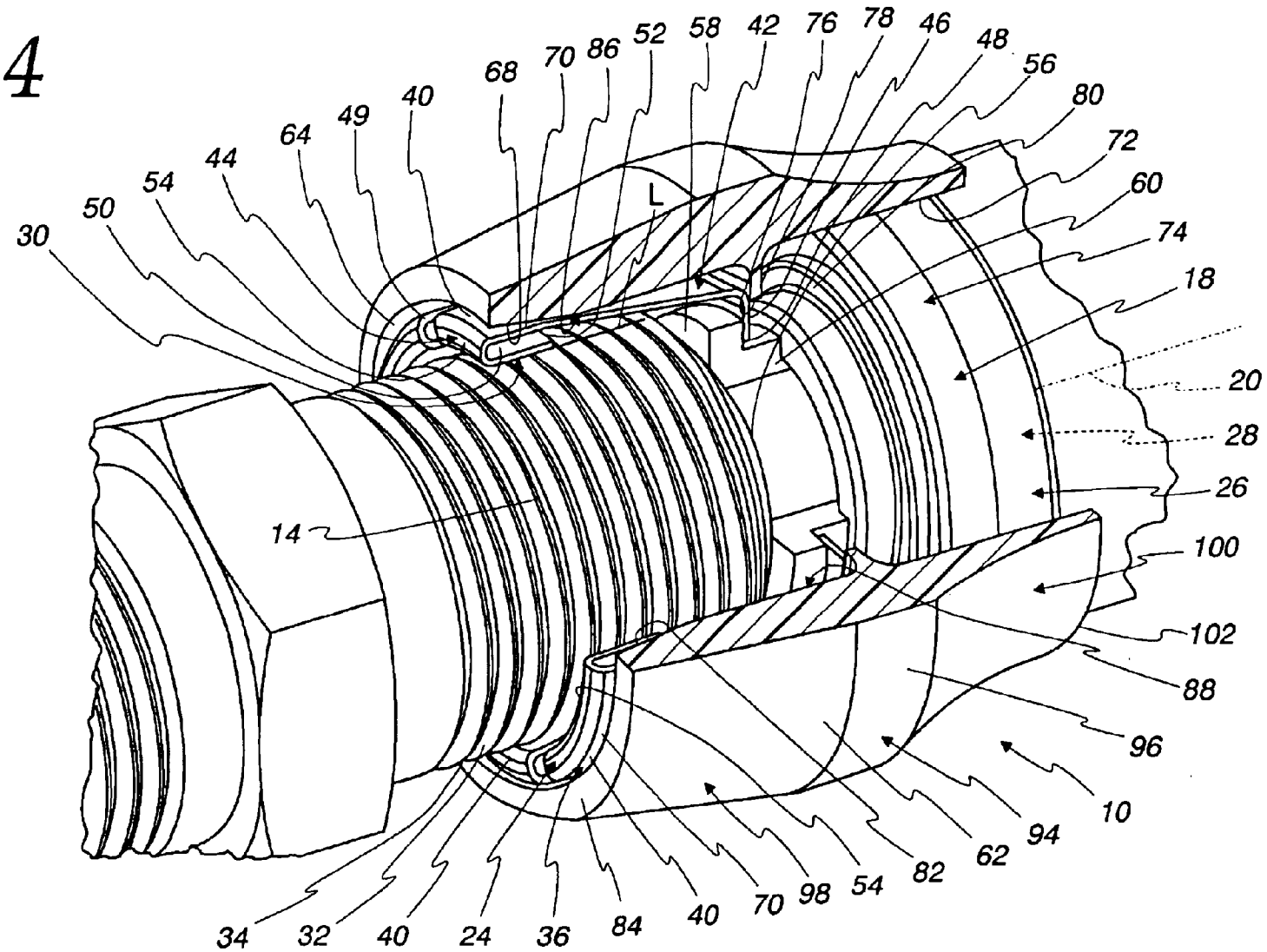
FIG. 4 is a view as in FIG. 3 with the locking member moved to a second position to thereby place the fingers in a locked state.

The connecting assembly 10, as seen in FIGS. 2–4, consists of a tubular fitting 18 with a central axis 20. The tubular fitting 18 has first and second, axially spaced end 22,24, respectively. The tubular fitting 18 consists of a sleeve assembly 26 defining a receptacle 28 for the cable 12, which is inserted therein from the first end 22 of the tubular fitting 18. The details of the sleeve assembly 26 are shown and described in U.S. Pat. No. 6,153,830, which is incorporated herein by reference. The basic structure and operation of the sleeve assembly 26 will be described briefly below. However, the particular manner and means by which the cable 12 is connected to the tubular fitting 18 are not critical to the present invention.

The second end 24 of the tubular fitting 18 defines a receptacle 30 for the externally threaded connecting port 14. The externally threaded connecting port 14 has spiral threads 32. The outermost edge 34 of the threads 32 defines an effective diameter D (FIG. 2) for the externally threaded connecting port 14, which is directed into the receptacle 30 from the end 24 of the tubular fitting 18.

The receptacle 30 is bounded by a ferrule assembly at 36. The ferrule assembly 36 is defined by a plurality of elongate fingers 40 which are joined to each other so as to be spaced at regular circumferential intervals to cooperatively produce a cylindrical shape for the receptacle 30. More particularly, each finger 40 has axially spaced, connected and free ends 42,44. One annular piece 46 defines the connected ends 42 of the fingers 40 and a radially interned edge 48. The fingers 40 each have a circumferential width W (FIG. 2). A circumferential gap 49 having a width W1 (FIG. 2) is maintained between adjacent fingers 40.

Each of the fingers 40 is folded at its free end 44 to define a prong 50, projecting generally axially oppositely to the direction of projection of the fingers 40. Each prong 50 has a length which extends along a line L that is non-parallel to the central axis 20. More particularly, the line L is disposed at an angle θ (FIG. 2) to the central axis 20, with θ being on the order of 1–30°. Each prong 50 terminates at a free edge 52, which in this embodiment is shown to be substantially straight to reside in a plane extending generally orthogonally to the central axis 20. In one form, the entire ferrule assembly 36 is formed as one piece from a thin sheet of metal, which is stamped and formed to produce the finger and prong arrangement shown.

Figure 6:
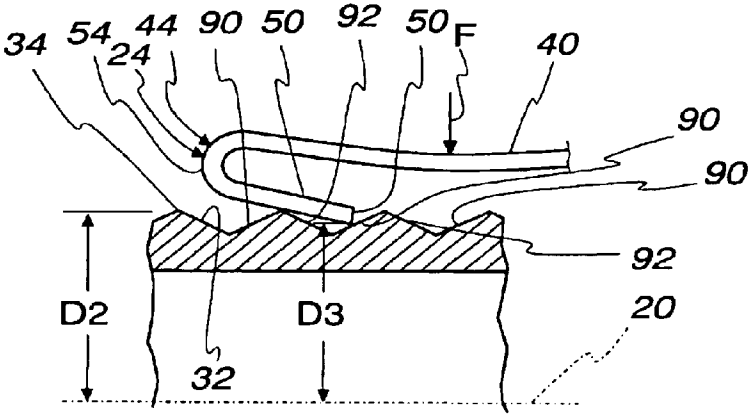
FIG. 6 is a view as in FIG. 5 with the finger in the locked state.
Figure 5:
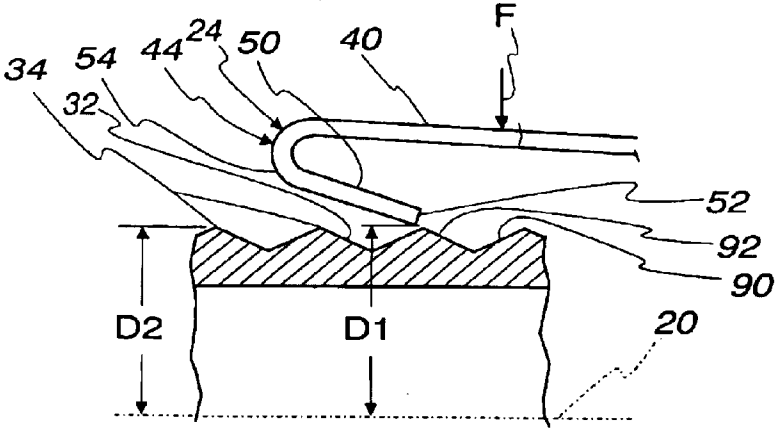
FIG. 5 is a fragmentary, schematic representation showing the relationship between a finger on the ferrule assembly on the connecting assembly and threads on the externally threaded connecting port, with the finger in the release state.

The fingers 40 are each independently bendable between a release position, as shown in FIGS. 2, 3 and 5, and a locked position, as shown in FIGS. 4 and 6. The ferrule assembly 36 is constructed so that the fingers 40 are each normally biased to their release position. As seen most clearly in FIG. 5, in the release position, the free edge 52 of each finger 40 is disposed a distance D1 from the central axis 20, which is greater than the distance D2 (½ D), which represents the spacing of the thread edges 34 from the central axis 20. With the fingers 40 in their release position, a circle centered on the axis 20 and passing through the prong free edges 52 has a diameter greater than the diameter D. Accordingly, the connecting port 14 can be translated into the receptacle 30 from the end 24 of the tubular fitting 18 and pass by the prong edges 52 without interference. By reason of having rounded surfaces 54 at the free end 44 of each finger 40 where the finger 40 folds to the prong 50, the connecting port 14 can be guided smoothly past the free ends 44 into the receptacle 30 on the connecting assembly 10. Further, the prongs 50 and fingers 40 may deflect radially outwardly as the connecting port 14 advances through the receptacle 30, whereby the prongs 50 serve both a biasing centering and guiding function as the connecting port 14 is advanced.

Once the connecting port 14 is fully seated in the receptacle 30, the free end 56 of the connecting port 14 abuts to a flange 58 on a metal connecting body 60 that is part of the sleeve assembly 26. The fingers 40 can then be simultaneously biased to the their locked position through a locking member 62. The locking member 62 has a generally cylindrical shape and extends continuously around the ferrule assembly 36 and a portion of the sleeve assembly 26. The locking member 62 has a radially inwardly facing, annular surface 64 with an annular surface portion 68 which surrounds and acts simultaneously against the radially outwardly facing surfaces 70 on the fingers 40. The surface 64 has an annular surface portion 72 which is guided against a radially outwardly facing surface 74 on the sleeve assembly 26. A radially inwardly projecting bead 76 on the locking member 62 axially divides the surface 64 to form the separate surface portions 68,72.

The locking member 62 is guided in relative axial movement between the first position, as shown in FIGS. 2 and 3, and the second position, shown in FIG. 4, through cooperation between the surface portion 68 and the surfaces 70 on the fingers 40, and the surface portion 72 and the surface 74 of the sleeve assembly 26. In the first position for the locking member 62, an axially facing surface 78 on the bead 76 abuts to a radially overlapping surface 80 on the sleeve assembly 26. By moving the locking member 62 from its first position, shown in FIGS. 2 and 3, in the direction of the arrow 81, the surface portion 68 produces a progressively increasing bias force on the fingers 40, radially inwardly relative to the axis 20, until the fingers 40 realize the locked position of FIGS. 4 and 6.

More specifically, the surface portion 68 has a camming/guiding length 82 which decreases in diameter away from the leading free end 84 of the locking member 62 to produce a funnel-shaped entry region. Between a transition location 86, at the axial end of the camming/guiding length 82, and continuing to the bead 76, the surface portion 68 has a uniform diameter at 88.

The fingers 40 and locking member surface portion 68 are relatively configured so that the surface portion 68 generates a radially inwardly directed biasing force F (FIG. 5 and 6) on the fingers 40 as the locking member 62 moves from its first position towards it second position. The camming/guiding length 82 generates an inward camming force F on the fingers 40 and, by reason of the "funnel" shape, allows the locking member 62 to move relative to the fingers 40 towards the second position without interference between the fingers 40 and the leading free end 84 of the locking member 62. As the transition location 86 continues to move axially from the connected ends 42 to the free ends 44 of the fingers 40, it produces an increasing bias force F that bends the fingers 40 progressively radially inwardly. The camming action from the camming/guiding length 82 may initially bend the fingers 40 to the point that the prongs 50 encounter the threads 32. Increased force application, through continued movement of the transition location 86 on the locking member 62, bends the fingers 40 radially inwardly more significantly at locations progressively approaching the finger free ends 44. As this occurs, the fingers 40 are squeezed radially, thereby resiliently biasing the prongs 50 against the threads 32. As seen in FIG. 6, the force F on the finger surfaces 70, produced through the surface 64 at the transition location 86, bows the fingers 40 between the connected ends 42 and the regions at which the prongs 50 abut the threads 32, which act as fulcrums, thereby positively loading the fingers 40 with a resilient, radially inward force.

The prongs 52 are in turn sufficiently flexible to at the same time bend towards the fingers 40 as the locking member 62 continues its axial path towards its second position. With the locking member 62 in the second position, the fingers 40 are in a locked state wherein free edges 52 of the prongs 50 reside a distance D3 from the axis 20, that is less than the distance D2, so that the free edges 52 reside between axially oppositely facing surfaces 90,92 on adjacent threads 32. As seen in FIG. 6, the prong free edge 52 is in radially overlapping relationship with the thread surface 90. The prong edge 52 and thread surface 90 confront each other to prevent axial withdrawal of the connecting port 14 from the receptacle 30 in the ferrule assembly 36. Depending upon the pitch of the threads 32, different ones of the fingers 40 will move between adjacent thread surfaces 90,92 to grip the threads 32 and prevent separation of the ferrule assembly 36 from the connecting port 14 by relative axial opposite movement. The locking member 62 can be moved axially to snug the connection to the desired tenacity.

The outer surface 94 of the locking member 62 is contoured to facilitate axial shifting thereof when gripped between the fingers of a user. The outer surface 94 has a center section 96 and a gripping portion 98 which taper progressively in diameter towards the leading free end 84, and a separate gripping portion 100 which tapers progressively from the center section 96 towards the opposite axial end of the locking member 62. The gripping portion 100 can be conveniently grasped in between the fingers of a user and pressed upon to move the locking member 62 from its first position into its second position. The gripping portion 98 can likewise be conveniently grasped between the user's fingers to exert a drawing force on the locking member 62 to thereby axially move the locking member 62 from the second position into the first position therefor.

The ferrule assembly 36, as described above, thus has two dimensions of flexing which permit the ferrule assembly 36 to accommodate a range of diameters for the connecting port 14. A slight bending of the fingers 40 may be sufficient to grip a connecting port 14 having a diameter in the larger anticipated useful range. The locking member 62 can radially compress the fingers 40 a substantially greater amount and will accommodate an even smaller diameter connecting port 14 by reason of the fact that the prongs 50 can bend outwardly towards the fingers 40. The fingers 40 and prongs 50 are configured so that even with the prongs 50 compressed towards the fingers 40, the line L of the length of each prong 50 remains at an angle to the central axis 20, so that the free edges 52 "dig into" the threads 32 on the connecting port 14.

The locking member 62 can be made from metal or plastic material. Preferably, the locking member 62 is made from a high friction 20 material, such as plastic. The part configuration lends itself to manufacture by an injection molding process. With a plastic construction, the locking member 62 frictionally binds with the fingers 40 and sleeve assembly 26 to potentially positively maintain the locking member 62 in each of its first and second positions and positions therebetween, while allowing axial repositioning of the locking member 62 through application of force through the user's fingers, without requiring any tools. Of course, the parts could be configured so that tools are required and potentially a more positive connection can be established. By moving the locking member 62 back into its first position, the fingers 40 are allowed to spring back to their release positions, thereby permitting withdrawal of the connecting port 14 from the receptacle 30 in the ferrule assembly 36 without interference from the fingers 40.

Figure 8:
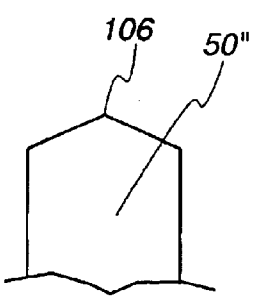
FIG. 8 is a view as in FIG. 7 of a further modified form of prong free edge.
Figure 7:
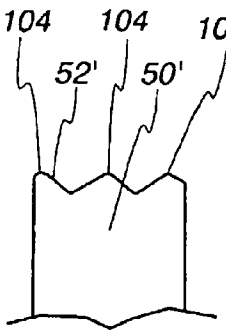
FIG. 7 is a fragmentary plan view of an alternative form of a free edge on a prong, carried by the fingers in FIGS. 2–6.

The prong configuration is not limited to that shown in FIGS. 2–6. As seen in FIG. 7, one or more of the prongs 50' may have an irregular free edge 52', defining in this case a plurality of projections 104 which can locate between the threads 32 to effect positive locking. As another alternative, as shown in FIG. 8, the prongs 50" could taper to a single point/projecting 106.

Several variations of the structure described above are contemplated. For example, the fingers 40 need not have the same construction. The number of fingers 40 can vary from as few as two to as many as eight or more it is only important that at least two fingers 40 be provided on the ferrule assembly 36 to captively embrace the connecting port 14.

Similarly, the length of the fingers and the prongs 50, as well as the angular orientation of the fingers 40 and prongs 50 relative to the fingers 40, can be varied to change the range of diameters with which the connecting assembly 10 will be functional.

Figure 9:
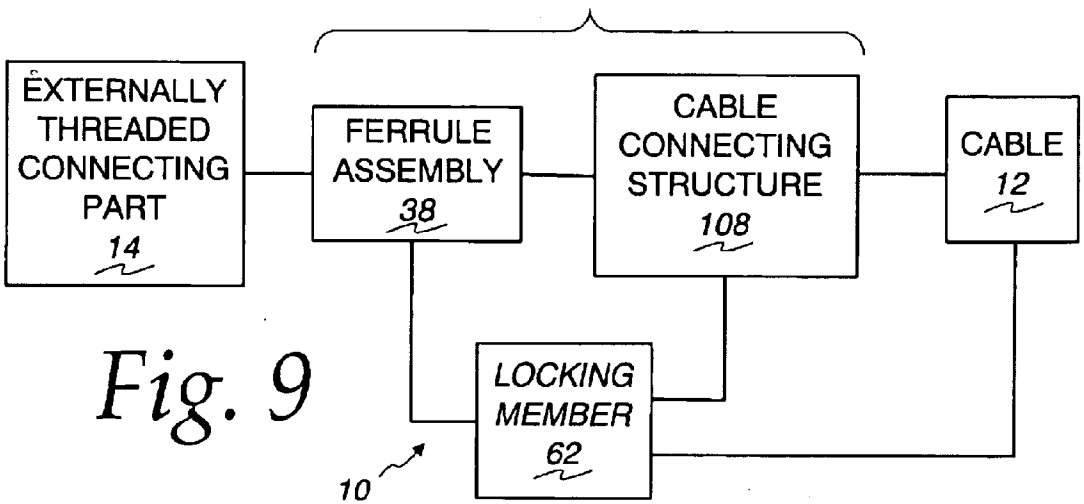
FIG. 9 is a schematic representation of the inventive connecting assembly operatively connected to a cable and to an externally threaded connecting port.

As noted above, the precise structure for connecting the cable 12 to the connecting assembly 10 is not critical to the present invention. As shown in FIG. 9, all that is required is a cable connecting structure 108 which can attach to the cable 12 so that the cable 12 and/or cable connecting structure 108 supports the ferrule assembly 38. The locking member 62 can be guided by the ferrule assembly 38, and one or both of the cable connecting structure 108 and cable 12, between its first and second positions.

As previously noted, the sleeve assembly 26 functions as the cable connecting structure 108, as seen in U.S. Pat. No. 6,153,830. The support sleeve 26 consists in part of the connecting body 60, which wedges between the metallic sheath and insulating core on the coaxial cable 12. An axially slidable sleeve part 110 is advanced from a starting position (not shown) axially in the direction of the arrow 81 in FIG. 2 into the FIG. 2 position, wherein the sleeve part 110 cams an underlying extension 111 of a sleeve part 112 so that the insulating jacket on the coaxial cable is compressively captured between the sleeve parts 112 and the connecting body 60.

While the invention has been described with particular reference to the drawings, it should be understood that various modifications could be made without departing from the spirit and scope of the present invention.

What is claimed is:

1. An assembly for connecting a cable to an externally threaded connecting port, the connecting assembly comprising:

a tubular fitting having a central axis and axially spaced first and second ends, the first end adapted to receive a cable, the second end adapted to engage an externally threaded connecting port to secure the connecting assembly to the externally threaded connecting port, the connecting assembly comprising a plurality of fingers projecting generally in a first axial direction, a first finger in the plurality of fingers having an axial length between axially spaced connected and free ends and a prong projecting generally oppositely to the first axial direction from a first axial location on the first finger; and a locking member that is movable axially relative to the first finger between first and second positions, the locking member having a surface that cooperates with a surface on the first finger to produce a bias force on the first finger radially inwardly relative to the central axis as the locking member is moved from the first position into the second position, the bias force produced on the first finger between the first location and the connected end of the first finger.

2. The assembly for connecting a cable to an eternally threaded connecting port according to claim 1 wherein the prong is substantially straight and projects in a line that is non-parallel to the central axis.

3. The assembly for connecting a cable to an externally threaded connecting port according to claim 1 wherein the first finger is folded at the free end to define the prong.

4. The assembly for connecting a cable to an externally threaded connecting port according to claim 1 wherein the first axial location is at the free end of the first finger.

5. The assembly for connecting a cable to an externally threaded connecting port according to claim 1 wherein there is a sleeve assembly at the first end of the tubular fitting for receiving a cable and the locking member abuts to the sleeve assembly with the locking member in the first position so as to prevent movement of the locking member from the second position to past the first position.

6. The assembly for connecting a cable to an eternally threaded connecting port according to claim 5 wherein the locking member has a radially inwardly projecting bead that abuts to the sleeve assembly with the locking member in the first position.

7. The assembly for connecting a cable to an externally threaded connecting port according to claim 6 wherein the locking member surrounds a portion of the sleeve assembly.

8. The assembly for connecting a cable to an externally threaded connecting port according to claim 5 wherein the locking member surface has an annular shape with a diameter that changes along an axial extent thereof.

9. The assembly for connecting a cable to an eternally threaded connecting port according to claim 5 wherein the locking member has a cylindrical shape that extends continuously around the plurality of fingers.

10. The assembly for connecting a cable to an externally threaded connecting port according to claim 5 wherein the locking member is made from a plastic material.

11. The assembly for connecting a cable to an externally threaded connecting port according to claim 1 wherein the prong projects in a line and terminates at a free edge which is substantially straight and extends transversely to the line at which the prong projects.

12. The assembly for connecting a cable to an externally threaded connecting port according to claim 1 wherein the prong terminates at a pointed free edge.

13. The assembly for connecting a cable to an externally threaded connecting port according to claim 1 wherein the fingers in the plurality of fingers have substantially the same configuration as the first finger.

14. The assembly for connecting a cable to an externally threaded connecting port according to claim 1 wherein the prong projects in a line and is flexible relative to the first finger to change the orientation of the line relative to the first finger.

15. The assembly for connecting a cable to an externally threaded connecting port according to claim 1 wherein the prong resides radially inside of the first finger.

16. An assembly for connecting a cable to an externally threaded connecting port, the connecting assembly comprising:

a tubular fitting having a central axis and axially spaced first and second ends, the first end adapted to receive a cable, the second end adapted to engage an externally threaded connecting port to secure the connecting assembly to the externally threaded connecting port, the connecting assembly comprising a plurality of fingers projecting generally in a first axial direction, a first finger in the plurality of fingers having an axial length between axially spaced connected and free ends and a prong projecting generally oppositely to the first axial direction from a first axial location on the first finger, and a locking member that is movable between first and second positions, the locking member producing a bias force on the first finger that moves at least a part of the first finger radially inwardly relative to the central axis as the locking member is moved from the first position into the second position, wherein the prong projects in a line and is flexible relative to the first finger to change the orientation of the line relative to the first finger.

17. The assembly for connecting a cable to an externally threaded connecting port according to claim 16 wherein the first finger is folded at the free end to define the prong.

18. The assembly for connecting a cable to an externally threaded connecting port according to claim 16 wherein the first axial location is at the free end of the first finger.

19. The assembly for connecting a cable to an externally threaded connecting port according to claim 16 wherein the bias force is produced on the first finger between the first location and the connected end of the first finger.

20. The assembly for connecting a cable to an externally threaded connecting port according to claim 16 wherein the locking member has an annular shape and is movable axially between the first and second positions.

21. The assembly for connecting a cable to an externally threaded connecting port according to claim 16 wherein the fingers in the plurality of fingers have substantially the same configuration as the first finger.

22. The assembly for connecting a cable to an externally threaded connecting port according to claim 16 wherein the prong resides radially inside of the first finger.

23. In combination:

a) an externally threaded connecting port having threads with an external diameter, the threads further having axially oppositely facing surfaces; and b) an assembly for connecting a cable to the externally threaded connecting port, the connecting assembly comprising:

a tubular fitting having a central axis and axially spaced first and second ends, the first end adapted to receive a cable, the second end engaging the externally threaded connecting port, the connecting assembly comprising a plurality of fingers projecting generally in a first axial direction, a first finger in the plurality of fingers having an axial length between axially spaced connected and free ends and a prong projecting generally oppositely to the first axial direction from a first axial location on the first finger, and a locking member that is movable axially relative to the first finger between first and second positions, the locking member having a surface that cooperates with a surface on the first finger to produce a bias force on the first finger radially inwardly relative to the central axis as the locking or is moved from the first position into the second position, wherein the locking member can be selectively placed and frictionally maintained in each of the first and second positions.

24. The combination according to claim 23 wherein the second end of the tubular fitting has a receptacle for the externally threaded connecting port and with the locking member in the first position, the first finger is biased radially outwardly so as not to engage the threads on the externally threaded connecting port as the externally threaded connecting port is directed axially relative to and into the receptacle in the second end of the tubular fitting.

25. The combination according to claim 23 wherein the first finger is folded to define the prong.

26. The combination according to claim 24 wherein the first finger is folded at the free end of the first finger.

27. The combination according to claim 23 wherein the fingers in the plurality of fingers have substantially the same configuration as the first finger.

28. The combination according to claim 23 wherein the prong projects in a line and is flexible relative to the first finger to change the orientation of the line relative to the first finger.

29. The combination according to claim 23 wherein with the locking in the second position, the first finger is biased so that the prong resides in radially overlapping relationship with one of the axially oppositely facing thread surfaces.

30. In combination:

a) an externally threaded connecting port having threads with an external diameter, the threads further having axially oppositely facing surfaces; and b) an assembly for connecting a cable to the externally threaded connecting port, the connecting assembly comprising:

a tubular fitting having a central axis and axially spaced first and second ends, the first end adapted to receive a cable, the second end defining a receptacle to receive the externally threaded connecting port and adapted to engage the externally threaded connecting port to secure the connecting assembly to the externally threaded connecting port, the connecting assembly comprising a plurality of fingers projecting generally in a first axial direction, a first finger in the plurality of fingers having an axial length between axially spaced connected and free ends and a prong projecting generally oppositely to the first axial direction from a first axial location on the first finger, the first finger normally biased to a release position, a locking member, the connecting assembly further comprising means cooperating between the locking member and at least the plurality of fingers for (a) allowing the locking member to be placed and frictionally maintained in the first and second positions, (b) biasing the first finger into a locked position wherein the prong extends into radially overlapping relationship with one of the axially oppositely facing thread surfaces, with the locking member in the second position, and (c) allowing the first finger to assume the release position wherein the prong resides outside of the external diameter of the threads with the locking member in the first position.

31. The combination according to claim 30 wherein the second end of the tubular fitting has a receptacle for the externally threaded connecting port and with the locking member in the first position, the first finger is biased radially outwardly so as not to engage the threads on the externally threaded connecting port as the externally threaded connecting port is directed axially relative to and into the receptacle in the second end of the tubular fitting.

32. The combination according to claim 30 wherein the first finger is folded to define the prong.

33. The combination according to claim 30 wherein the fingers in the plurality of fingers have substantially the same configuration as the first finger.

34. A method of connecting a cable to an externally threaded connecting port having threads, the threads having an external diameter and axially oppositely facing surfaces, the method comprising the steps of:

providing a connecting assembly comprising: a) a tubular fitting having a central axis and axially spaced first and second ends; b) a plurality of fingers projecting generally in a first axial direction so that the plurality of fingers cooperatively defines a receptacle, a first finger in the plurality of fingers having an axial length between axially spaced connected and free ends and a prong projecting generally oppositely to the first axial direction from a first axial location on the first fingers, and c) a locking member that is movable relative to the first finger between first and second positions;

moving the locking member into the first position so that the locking member is frictionally maintained in the first position;

with the locking member in the first position directing the externally threaded connecting port into the receptacle with the first finger in a position so that the prong on the first finger does not engage the threads on the externally threaded connecting port;

with the externally threaded connecting port in the receptacle, moving the locking member from the first position towards the second position and thereby causing the locking member to produce a force in the first finger that biases the first finger so as to situate the prong in radially overlapping relationship with one of the axially oppositely facing thread surfaces so that the prong abuts to the one of the axially oppositely facing thread surfaces to prevent separation of the externally threaded connecting port and connecting assembly by relative axially opposite movement; and connecting a cable to the second end of the tubular fitting.

35. The method of connecting a cable to an externally threaded connecting port according to claim 34 wherein the step of moving the locking member comprises causing the locking member to produce the force from a location between the connecting and free ends of the first finger.

36. The method of connecting a cable to an externally threaded connecting port according to claim 34 wherein the step of providing a connecting assembly comprises providing a connecting assembly with a plurality of fingers that are substantially the same as the first finger and which cooperate with the locking member in substantially the same manner as the locking member cooperates with the first finger.

37. The method of connecting a cable to an externally threaded connecting port according to claim 34 wherein the step of moving the locking member comprises causing the locking member to produce a force that repositions the prong relative to the first finger.

* * * * *